US008708060B2

(12) United States Patent
Tsuge

(10) Patent No.: US 8,708,060 B2
(45) Date of Patent: Apr. 29, 2014

(54) CLUTCH MECHANISMS FOR POWER SCREWDRIVERS

(75) Inventor: Kazunori Tsuge, Anjo (JP)

(73) Assignee: Makita Corporation, Anjo-Shi (JP)

( * ) Notice: Subject to any disclaimer, the term of this patent is extended or adjusted under 35 U.S.C. 154(b) by 512 days.

(21) Appl. No.: 13/179,933

(22) Filed: Jul. 11, 2011

(65) Prior Publication Data

US 2012/0018183 A1 Jan. 26, 2012

(30) Foreign Application Priority Data

Jul. 22, 2010 (JP) ..... 2010-164926

(51) Int. Cl.
*B25B 23/157* (2006.01)

(52) U.S. Cl.
USPC ..... 173/178; 173/48; 173/216; 192/54.5; 192/56.61; 192/150; 81/467; 81/473

(58) Field of Classification Search
USPC ..... 173/48, 176, 178, 109, 213, 216, 217; 192/34, 54.5, 56.61, 150; 81/429, 467, 81/473, 474, 475
See application file for complete search history.

(56) References Cited

U.S. PATENT DOCUMENTS

| | | | | |
|---|---|---|---|---|
| 4,446,931 | A * | 5/1984 | Bleicher et al. | 173/48 |
| 4,892,013 | A * | 1/1990 | Satoh | 475/266 |
| 5,343,961 | A * | 9/1994 | Ichikawa | 173/48 |
| 5,372,206 | A * | 12/1994 | Sasaki et al. | 173/178 |
| 5,538,089 | A * | 7/1996 | Sanford | 173/2 |
| 5,568,849 | A * | 10/1996 | Sasaki et al. | 192/34 |
| 5,947,210 | A * | 9/1999 | Sasaki et al. | 173/178 |
| 6,173,792 | B1 * | 1/2001 | Hald | 173/178 |
| 6,536,537 | B1 * | 3/2003 | Sasaki et al. | 173/178 |
| 7,100,482 | B2 * | 9/2006 | Neumaier | 81/429 |
| 7,168,505 | B2 * | 1/2007 | Yamada | 173/178 |
| 7,325,624 | B2 * | 2/2008 | Yamazaki | 173/48 |
| 8,087,474 | B2 * | 1/2012 | Shinma et al. | 173/48 |

FOREIGN PATENT DOCUMENTS

| | | |
|---|---|---|
| EP | 0 133 645 A2 | 6/1984 |
| JP | A-4-129677 | 4/1992 |
| JP | A-5-104453 | 4/1993 |
| JP | A-2005-066782 | 3/2005 |
| JP | A-2006-116655 | 5/2006 |
| JP | A-2006-159306 | 6/2006 |
| JP | A-2010-094773 | 4/2010 |

OTHER PUBLICATIONS

Extended European Search Report issued in European Application No. 11174433.0 dated Oct. 19, 2011.
Office Action issued in Japanese Patent Application No. 2010-164926 dated Jan. 7, 2014 (with translation).

* cited by examiner

*Primary Examiner* — Scott A. Smith
(74) *Attorney, Agent, or Firm* — Oliff PLC

(57) ABSTRACT

A synchronization mechanism of a clutch mechanism includes a drive side contact member and a driven side contact member provided on a drive side clutch member and a driven side clutch member of a clutch mechanism at positions radially inwardly of a drive side clutch portion and a driven side clutch portion, respectively. The driven side contact member does not contact the drive side contact member when the driven side clutch member is in a disengaging position. As the driven side clutch member moves from the disengaging position to an engaging position, the driven side contact member contacts the drive side contact member, so that the rotation of the drive side clutch member is transmitted to the driven side clutch member through frictional contact between the driven side contact member and the drive side contact member before the driven side clutch member reaches the engaging position.

22 Claims, 3 Drawing Sheets

CLUTCH MECHANISMS FOR POWER SCREWDRIVERS

This application claims priority to Japanese patent application serial number 2010-164926, the contents of which are incorporated herein by reference.

BACKGROUND OF THE INVENTION

1. Field of the Invention

The present invention relates to clutch mechanisms, and in particular to clutch mechanism usable for power screwdrivers.

2. Description of the Related Art

Hand-held power screwdrivers are known that can be held by a hand of an operator for performing a screw driving operation. In order to drive a screw into a workpiece, the operator sets the screw to a driver bit mounted to a front end of a spindle and presses the screwdriver toward the workpiece, so that the spindle retreats to connect a clutch mechanism, whereby the spindle rotates to drive the screw into the workpiece.

The clutch mechanism is provided between a driver side member and the spindle. The spindle is supported so as to be movable in an axial direction relative to the drive side member. In general, the clutch mechanism is a meshing clutch and includes drive-side clutch teeth and driven-side clutch teeth. The rotation is transmitted from the drive side member to the spindle when the drive-side and driven-side clutch teeth engage with each other according to the axial movement of the spindle. No rotation is transmitted when the drive-side and driven-side clutch teeth are disengaged from each other.

As the spindle advances according to the progress of the driving operation, the engagement between the drive-side clutch teeth and the driven-side clutch teeth becomes shallower. When the screw has been completely driven, the engagement between the drive-side clutch teeth and the driven-side clutch teeth is released, so that the rotation of the spindle is stopped.

In this kind of meshing clutch mechanisms, there has been known to incorporate a synchronization mechanism for reducing an impact that may be produced when the drive-side and driven side clutch teeth are brought to be engaged with each other. Techniques relating to the synchronization mechanism are disclosed, for example, in Japanese Laid-Open Patent Publication No. 2005-066782 (also published as Japanese Patent No. 4334944) and Japanese Laid-Open Patent Publication No. 2010-94773. According to the synchronization mechanisms of these publications, prior to the engagement of the driven-side clutch teeth with the drive-side clutch teeth by the retreating movement of the spindle, a part of the rotative force is transmitted to the spindle to cause preliminary synchronized rotation of the spindle. Therefore, the drive-side clutch teeth and the driven-side clutch teeth engage with each other in the state that a difference in the rotational speed between these clutch teeth has been reduced. Hence, the clutch mechanism does not produce a substantial impact when it is connected. Because the clutch mechanism is smoothly connected without producing a substantial impact, the durability of the clutch mechanism is improved and the operation of the power screwdriver can be smoothly performed.

However, in the case of the synchronization mechanism disclosed in the above Publication No. 2005-066782, a diametrically deformable member, a movable member (a steel ball) and a positioning member are interposed between the spindle and a drive gear (i.e., a drive side member) in the state that they always receive a biasing force of a spring not only at a stage of causing synchronized rotation of the spindle. Although the movable member is in a point-to-point contact relationship with the spindle, a part of the rotational force of the drive side is always transmitted to the spindle. Therefore, it is difficult to completely inhibit rotation of the spindle when the spindle is in an initial position before the retreating movement. In addition, it has been desired to further reduce wear of the components that constitute the synchronization mechanism.

In the case of the synchronization mechanism disclosed in the Publication No. 2010-94773, a metal synchronization member provided on the spindle is brought to slidably contact with the outer circumference of a drive gear immediately before engagement of the clutch teeth, so that the frictional force causes synchronized rotation of the spindle. Therefore, there is a problem of causing substantial wear of the outer circumference of the drive gear.

Therefore, there is a need in the art for a clutch mechanism usable for a power screwdriver and having an improved synchronization mechanism.

SUMMARY OF THE INVENTION

According to the present teaching, a synchronization mechanism of a clutch mechanism includes a drive side contact member and a driven side contact member provided on a drive side clutch member and a driven side clutch member of a clutch mechanism at positions radially inwardly of a drive side clutch portion and a driven side clutch portion, respectively. The driven side contact member does not contact the drive side contact member when the driven side clutch member is in a disengaging position. As the driven side clutch member moves from the disengaging position to an engaging position, the driven side contact member contacts the drive side contact member, so that the rotation of the drive side clutch member is transmitted to the driven side clutch member through frictional contact between the driven side contact member and the drive side contact member before the driven side clutch member reaches the engaging position.

DETAILED DESCRIPTION OF THE INVENTION

Figure 1:
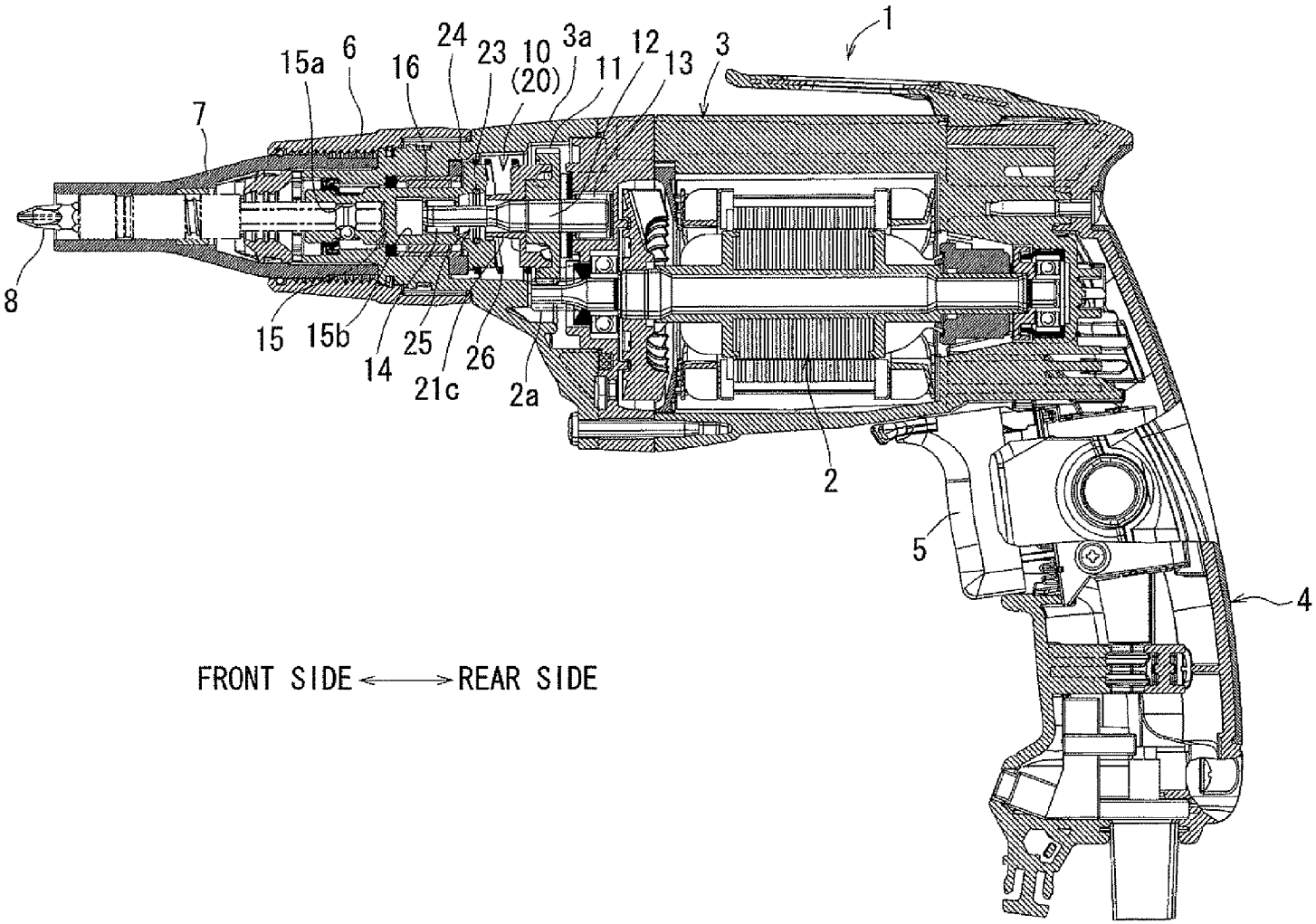
FIG. 1 is a sectional view showing an internal structure of a power screwdriver having a clutch mechanism according to a representative example.
Figure 2:
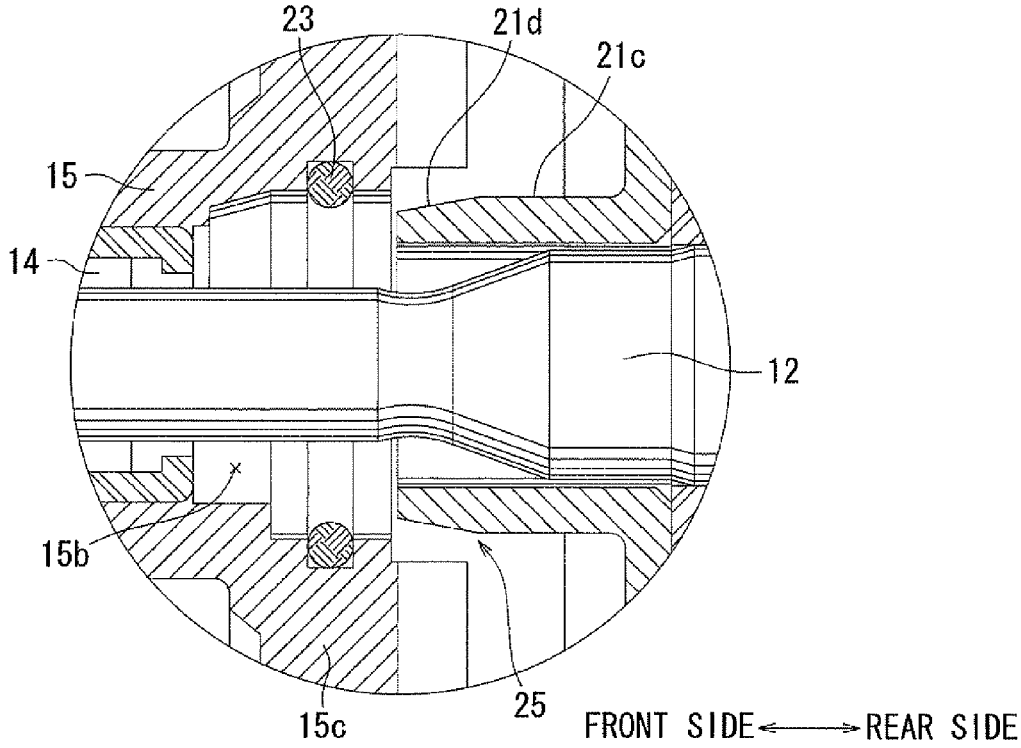
FIG. 2 is an enlarged view of a synchronization mechanism and its related parts of the clutch mechanism and showing the state where transmission of rotation is interrupted.
Figure 3:
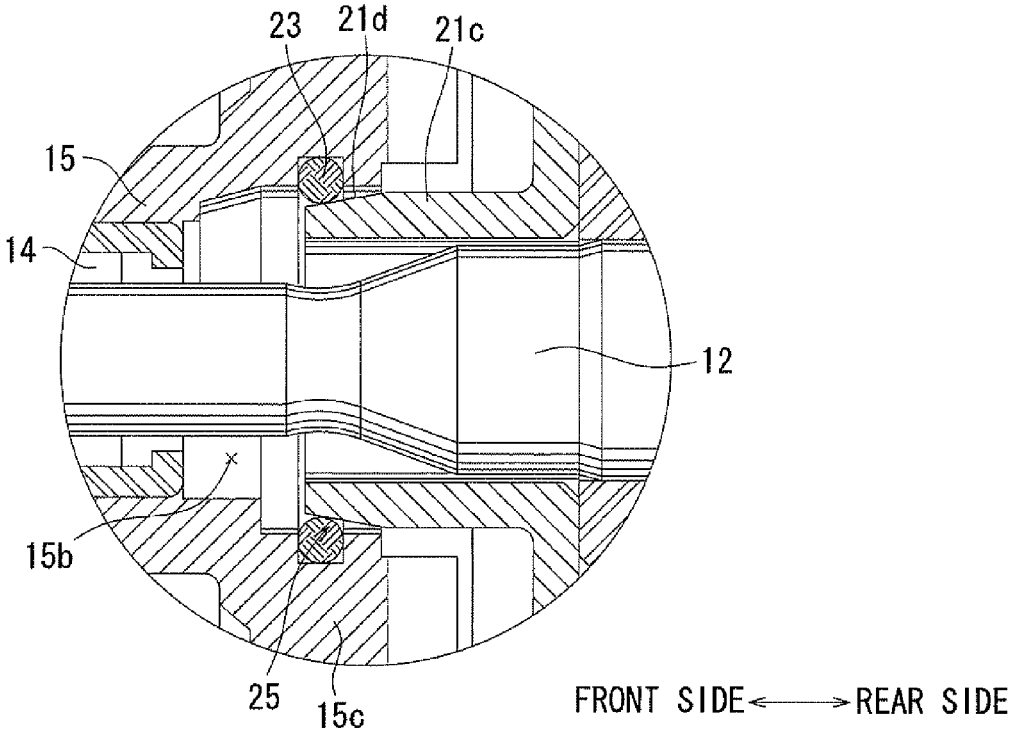
FIG. 3 is an enlarged view of the synchronization mechanism and its related parts and showing the state where rotation is transmitted by the synchronization mechanism.

Each of the additional features and teachings disclosed above and below may be utilized separately or in conjunction with other features and teachings to provide improved clutch mechanisms having synchronization mechanisms and power screwdrivers having such improved clutch mechanisms. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings. Various examples will now be described with reference to the drawings.

In one example, a power screwdriver includes a rotary drive device, a spindle configured to be capable of mounting a driver bit, and a clutch mechanism configured to transmit rotation of the rotary drive device to the spindle and comprising a drive side clutch member coupled to the rotary drive device and a driven side clutch member coupled to the spindle. The drive side clutch member and the driven side clutch member have drive side clutch teeth and driven side clutch teeth, respectively. The drive side clutch teeth and the driven side clutch teeth engage with each other and disengaged from each other according to the position of the driven side clutch member in an axial direction relative to the drive side clutch member. The power screwdriver further includes a synchronization mechanism including a drive side contact member and a driven side contact member. The drive side contact member and the driven side contact member are provided on the drive side clutch member and the driven side clutch member at positions radially inwardly of the drive side clutch teeth and the driven side clutch teeth, respectively. Prior to engagement of the driven side clutch teeth with the drive side clutch teeth during the axial movement of the driven side clutch member in a retreating direction, the drive side contact member and the driven side contact member frictionally slidably contact each other to transmit rotation of the drive side clutch member to the driven side clutch member, so that the driven side clutch member rotates in synchronism with the drive side clutch member.

With this arrangement, a frictional force is produced between the drive side and driven side contact members during the retreating movement of the driven side clutch member, so that a part of the rotational force of the drive side clutch member is applied to the driven side clutch member as a synchronization rotary force. When the driven side clutch member is positioned at the initial position that may be a forward stroke end, no frictional force is produced between the drive side and driven side contact members, and therefore, no rotational force is transmitted via the synchronization mechanism, and no synchronized rotation of the driven side clutch member occurs.

In addition, because the synchronizing force is transmitted through frictional sliding contact between the drive side contact member disposed radially inwardly of the drive side clutch teeth and the driven side contact member disposed radially inwardly of the driven side clutch teeth, it is possible to achieve a lower circumferential speed of the contact surfaces of the drive and driven side contact members than in the case that the drive side and driven side contact members are disposed radially outwardly of the drive side clutch teeth and the driven side clutch teeth, respectively. Therefore, it is possible reduce wear of the contact surfaces of the drive side and driven side contact members.

Further, because the drive side and driven side contact members of the synchronization mechanism are disposed radially inwardly, it is possible to keep the power screwdriver to be downsized without need of increase of the size of the clutch mechanism in the radial direction.

The drive side contact member and the driven side contact member may be configured to increase the frictional force therebetween as a moving distance of the driven side clutch member in the retreating direction increases. With this arrangement, the synchronizing rotational force increases as the driven side clutch member retreats. Therefore, it is possible to achieve a smooth synchronization and to further reduce an impact produced when the clutch is connected.

The drive side clutch member may include a restricting shaft portion, and the driven side clutch member may include a restricting recess configured to receive the restricting shaft portion. A restricting member is mounted to one of an outer circumferential surface of the restricting shaft portion and an inner circumferential surface of the restricting recess. A tapered surface is formed on the other of the outer circumferential surface of the restricting shaft portion and the inner circumferential surface of the restricting recess. The drive side contact member includes one of the restricting member and the tapered surface, while the driven side contact member includes the other of the restricting member and the tapered surface.

With this arrangement, as the driven side clutch member retreats, the restricting shaft portion enters the restricting recess, so that the restricting member frictionally slidably contacts the tapered surface to gradually increase the synchronization rotational force.

In one example, the drive side contact member includes the tapered surface formed on the outer circumferential surface of the restricting shaft portion, and the driven side contact member includes the restricting member mounted to the inner circumferential surface of the restricting recess. In an alternative example, the drive side contact member includes the restricting member mounted to the restricting shaft portion, and the driven side contact member includes the tapered surface formed on the inner circumferential surface of the restricting recess. The restricting member may be a resilient member, such as a rubber ring.

The power screwdriver may further include a biasing device interposed between the drive side clutch member and the driven side clutch member for biasing the driven side clutch member toward an initial position in a direction opposite to the retreating direction. The biasing device may serve to transmit a part of the rotational force of the drive side clutch member to the driven side clutch member. In other words, the biasing device may serve as a second synchronization mechanism that applies a synchronizing rotational force that increases as the retreating distance of the driven side clutch member increases.

The drive side clutch member may include a first drive clutch member coupled to the rotary drive device and having the drive side clutch teeth and first cam recesses, a second drive clutch member having second cam recesses, and balls interposed between the first drive clutch member and the second drive clutch member and each fitted into one of the first cam recesses and one of the second cam recesses, so that the first drive clutch member moves in the axial direction to cause engagement and disengagement of the drive side clutch teeth with the driven side clutch teeth as the first drive clutch member rotates relative to the second drive clutch member.

Because the engagement and disengagement of the drive side clutch teeth with the driven side clutch teeth is spontaneously performed by the axial movement of the first drive clutch member, the above arrangement provides a silent clutch function to the clutch mechanism in addition to the synchronization function. Therefore, it is possible to further reliably reduce an impact produced when the clutch mechanism is connected. It is also possible to ensure the silent property when the clutch mechanism is disconnected. As a result, it is possible to improve the durability of the clutch mechanism.

The power screwdriver may further include a co-rotation preventing member. The co-rotation preventing member engages the driven side clutch member to prevent rotation of the driven side clutch member when the driven side clutch member returns to an initial position in a direction opposite to the retreating direction. Therefore, it is possible to reliably prevent rotation of the driven side clutch member with the drive side clutch member when the driven side clutch member has returned to the initial position.

A representative example will now be described with reference to the drawings. Referring to FIG. 1, there is shown a hand-held power screwdriver 1 having a clutch mechanism 10. The power screwdriver 1 generally includes a tool body 3 having an electric motor 2 disposed therein, and a handle 4 disposed at a rear portion of the tool body 3 and protruding laterally (downwardly as viewed in FIG. 1) therefrom. A trigger-type switch lever 5 is mounted to the handle 4 at a position proximal to the base portion of the handle 4. In order to start the motor 2, the operator can push the switch lever 5 with fingers of his or her one hand that grasps the handle 4. An adjustment sleeve 6 is rotatably mounted to the front portion of the tool body 3 and is operable to adjust a driving depth of a screw (not shown). More specifically, as the adjustment sleeve 6 rotates, a locator 7 moves forwardly or rearwardly due to thread engagement with the adjustment sleeve 6. A front end of a driver bit 8 protrudes forwardly from the front end of the locator 7. Therefore, rotation of the adjustment sleeve 6 causes forward or rearward movement of the locator 7 to change its position relative to the driver bit 8, so that the driving depth can be adjusted.

An output gear 2*a* is formed on an output shaft of the electric motor 2 and engages a drive gear 11. The drive gear 11 is rotatably supported by the tool body 3 via an intermediate shaft 12. The rear portion of the intermediate shaft 12 is rotatably supported by a housing 3*a* of the tool body 3 via a bearing 13. The front portion of the intermediate shaft 12 is supported by a spindle 15 via a bearing 14 such that the intermediate shaft 12 can rotate relative to the spindle 15 about its axis and can move in an axial direction (i.e., forward and rearward directions) of the spindle 15. The bearing 14 is mounted within a restriction recess 15*b* formed in the rear portion of the spindle 15. The spindle 15 is supported by the housing 3*a* of the tool body 3 via a sleeve-like bearing 16 such that the spindle 15 can rotate relative to the housing 3*a* about its axis and can move in the axial direction. The driver bit 8 is fitted into a bit fitting hole 15*a* formed in the front end of the spindle 15.

Figure 4:
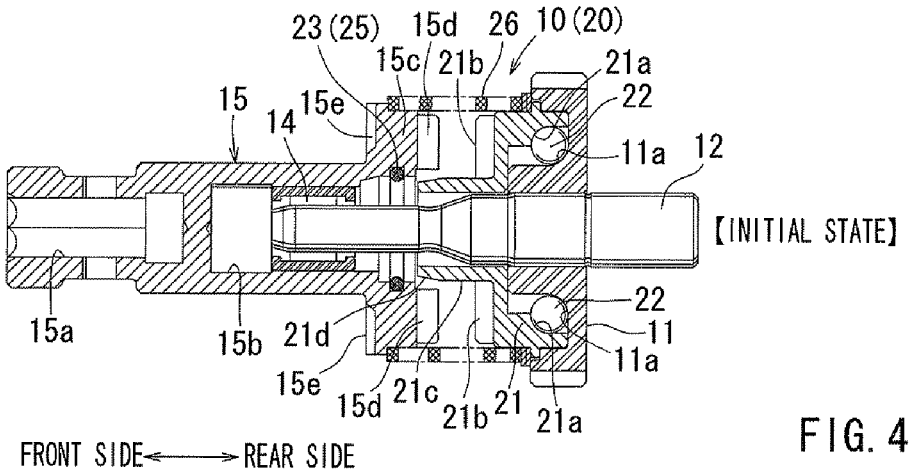
FIG. 4 is an enlarged sectional view of the clutch mechanism and its related parts and showing the state where a spindle is returned to an initial position.
Figure 5:
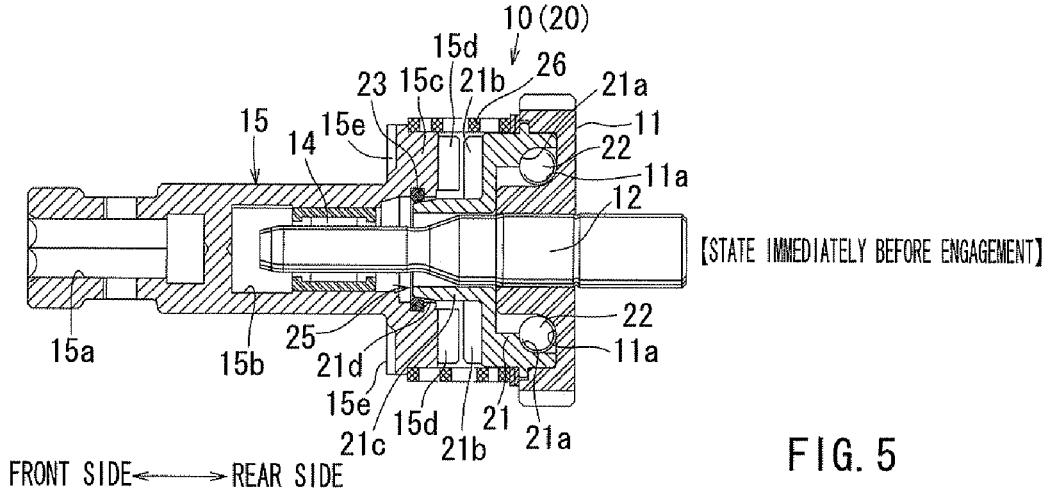
FIG. 5 is a view similar to FIG. 4 but showing the state where the spindle is in the midway of its retreating movement immediately before engagement of clutch teeth.
Figure 6:
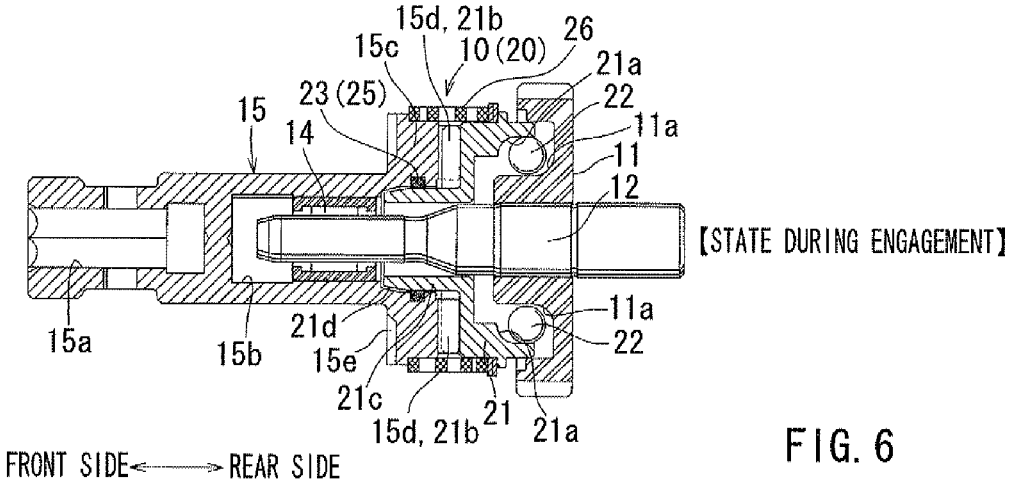
FIG. 6 is a view similar to FIG. 4 but showing the state where the clutch teeth are engaged.

A clutch mechanism 10 is provided between the spindle 15 and the drive gear 11. The clutch mechanism 10 is operable to transmit rotation of the electric motor 2 (i.e., a drive device) to the spindle 15 (i.e., a driven side member) and to interrupt transmission of rotation to the spindle 15. The details of the clutch mechanism 10 are shown in FIGS. 4 to 6. In this example, the clutch mechanism 10 is configured as a so-called "silent clutch mechanism." This silent clutch mechanism is labeled with reference numeral 20. Because the principle of the silent clutch mechanism is known in the art, the silent clutch mechanism 20 will be described in brief. A clutch plate 21 is disposed on the front side of the drive gear 11 (i.e., a drive side member) so as to be rotatable relative to the drive gear 11 about the same axis as the drive gear 11 and to be movable toward and away from the drive gear 11 in the axial direction.

Three balls 22 made of steel are interposed between the drive gear 11 and the clutch plate 21. Cam recesses 11*a* are formed in the drive gear 11 and cam recesses 21*a* are formed in the clutch plate 21. Each of the balls 22 engages one of the cam recesses 11*a* and one of the cam recesses 21*a*. The cam recesses 11*a* and the can recesses 21*a* are configured such that their depths vary in the rotational direction of the drive gear 11. Therefore, as the clutch plate 21 rotates relative to the drive gear 11, each ball 22 moves within the corresponding cam recesses 11*a* and 21*a* to cause movement of the clutch plate 21 toward and away from the drive gear 11. FIG. 4 shows a transmission interruption state where the clutch plate 21 is positioned away from the drive gear 11. FIG. 6 shows a transmission state where the clutch plate 21 is positioned proximal to the drive gear 11. FIG. 6 shows a synchronized rotation state immediately before engagement of clutch teeth 15*d* of the spindle 15 with the clutch teeth 21*b* of the clutch plate 21 during the retreating movement of the spindle 15.

A cylindrical tubular restricting shaft portion 21*c* protrudes forwardly from the front surface of the clutch plate 21. The intermediate shaft 12 is inserted into the restricting shaft portion 21*c*. The restricting shaft portion 21*c* is configured to have such an outer diameter that allows the restricting shaft portion 21*c* to enter the restriction recess 15*b* of the spindle 15. An outer circumferential surface of a front end of the restricting shaft portion 21*c* is configured as a tapered surface 21*d* having a diameter decreasing toward the front side.

The clutch teeth 21*b* are formed on the front surface of the clutch plate 21 at a position around the restricting shaft portion 21*c* and each extends in a radial direction with respect to the rotational axis of the clutch plate 21 that is the same as the axis of the intermediate shaft 12.

A flange portion 15*c* is formed on the rear portion of the spindle 15 so as to be opposed to the clutch plate 21. The clutch teeth 15*d* are formed on the rear surface of the flange 15*c* around the circumferential edge of the opening of the restriction recess 15*b* and each extends radially with respect to the rotational axis of the spindle 15.

As will be explained later, the clutch mechanism 10 is connected to transmit the rotation of the drive gear 11 (i.e., a drive side member) to the spindle 15 (i.e., a driven side member) when the spindle 15 retreats to cause engagement of the clutch teeth 15*d* with the clutch teeth 21*b* of the clutch plate 21. In this example, the clutch plate 21 having the clutch teeth 21*b* serves as a drive side clutch member. On the other, the clutch teeth 15*d* are formed on the flange portion 15*c* of the spindle 15, and therefore, the flange portion 15*c* serves as a driven side clutch member integrated with the spindle 15.

A compression spring 26 is interposed between the clutch plate 21 and the flange portion 15*c* of the spindle 15, so that the spindle 15 is biased by the spring 26 in a direction toward its forward stroke end (initial position) that is a disengaging position. The compression spring 26 may be replaced with any other biasing member as long as it can bias the spindle 15 toward the initial position.

When the spindle 15 returns to its initial position by the compression spring 26, the front surface of the flange portion 15*c* abuts to a co-rotation preventing member 24. The co-rotation preventing member 24 is made of metal and has an annular configuration. Engaging claws (not shown) are formed on the rear surface of the co-rotation preventing member 24 opposed to the flange portion 15*c*. On the other hand, engaging recesses 15*e* having a relatively shallow depth are formed in the front surface of the flange portion 15*c* in a stepped manner and spaced from each other in the circumferential direction. Therefore, when the spindle 15 returns to the initial position, the engaging claws of the co-rotation preventing member 24 enter the engaging recesses 15*e* and engage therein. As a result, the spindle 15 is reliably prevented from rotating when it is positioned at the initial position.

An annular restricting member 23 is fitted into the restriction recess 15*b* of the spindle 15. In this example, the restricting member 23 is a rubber ring fitted into the restricting recess 15*b* along the inner circumferential surface of the restricting recess 15*b* at a position proximal to the opening at the rear end of the restricting recess 15*b*. As the spindle 15 retracts, the restricting shaft portion 21*c* of the clutch plate 21 moves into the restricting recess 15*b*, so that the restricting shaft portion 21*c* is inserted into the restricting member 23. The inner diameter of the restricting member 23 and the outer diameter of the restricting shaft portion 21*c* are determined such that, as the spindle 15 retracts, (a) the restricting member 23 frictionally slidably contacts the tapered surface 21*d* of the restricting shaft portion 21 as shown in FIG. 5 at the beginning of entry into the restricting shaft portion 21*c*, and (b) the restricting member 23 thereafter frictionally slidably contacts the outer circumferential surface of a part of the restricting shaft portion 21 positioned on the rear side of the tapered surface 21*d* as shown in FIG. 6. Due to the frictional sliding contact of the restricting member 23 with the restricting shaft portion 21*c* of the clutch plate 21, a part of the rotational force of the drive gear 11 (i.e., a drive side member) is transmitted to the spindle 15 (i.e., a driven side member) by the frictional force, so that the spindle 15 rotates in synchronism with the drive gear 11. In this way, in this example, the restricting shaft portion 21*c* and the restricting member 23 constitute a synchronization mechanism 25.

According to the power screwdriver 1 of the representative example described above, in order to use the power screwdriver 1, the operator first sets a screw to the front end of the driver bit 8. Thereafter, the operator pushes the switch lever 5 to start the electric motor 2 while he or she moves the power screwdriver 1 so as to press the screw against the workpiece. Therefore, the spindle 15 retreats to cause engagement of the clutch teeth 15*d* with the clutch teeth 21*b* of the clutch plate 21, so that the clutch mechanism 10 is connected to transmit rotation of the motor 2 to the spindle 15.

The clutch mechanism 10 of this example is configured as the silent clutch mechanism 20. According to the silent clutch mechanism 20, when the clutch teeth 15*d* of the spindle 15 contact the clutch teeth 21*b* of the clutch plate 21 during the retreating movement of the spindle 15, a resistance is applied to the clutch plate 21 against its rotation, so that relative rotation is caused between the clutch plate 21 and the drive gear 11. As the clutch plate 21 rotates relative to the drive gear 11, the balls 22 move along their respective cam recesses 11*a* and 21*a* toward the shallower side, so that the clutch plate 21 moves in a direction away from the drive gear 11. Because the clutch plate 21 moves in the direction away from the driver gear 11, which direction is toward the side of the spindle 15, the clutch teeth 21*b* of the clutch plate 21 are brought to instantaneously engage the clutch teeth 15*d* of the spindle 15. In this way, according to the silent clutch mechanism 20, the clutch teeth 21*b* of the clutch plate 21 are brought to instantaneously engage the clutch teeth 15*d* of the spindle 15 due to the forward movement of the clutch plate 21. Therefore, transmission of rotation can be smoothly performed.

In addition, the clutch mechanism 10 of the above example is provided with the synchronization mechanism 25 that transmits rotation of the clutch plate 21 to the spindle 15 to cause synchronized rotation of the spindle 15 in the midway of the retreating movement of the spindle 15 prior to engagement of the clutch teeth 15*d* of the spindle 15 with the clutch teeth 21*b* of the clutch plate 21. In order to cause the synchronized rotation of the spindle 15 with the drive side, the synchronization mechanism 25 is configured to transmit rotation of clutch plate 21 (in other words, the rotation of the drive gear 11 (the drive side member) and eventually the rotation of the motor 2 as the drive device) to the spindle 15 (i.e., the driven side member) by the frictional force produced by the sliding contact between the restricting shaft portion 21*c* of the clutch plate 21 positioned radially inwardly of the clutch teeth 21*b* and the restricting member 23 of the spindle 15 positioned radially inwardly of the clutch teeth 15*d*.

Thus, the synchronization mechanism 25 is configured to transmit rotation of the drive side member or the drive device to the spindle 15 by the frictional sliding contact between the restricting shaft portion 21*c* of the clutch plate 21 positioned radially inwardly of the clutch teeth 21*b* and the restricting member 23 positioned radially inwardly of the clutch teeth 15*d*. In other words, the restricting shaft portion 21*c* serves as a drive side contact member provided on the clutch plate 21 and having a drive side contact surface (including the tapered surface 21*d*), while the restricting member 23 serves as a driven side contact member provided on the spindle 15 and having a driven side contact surface (i.e., the inner circumferential surface of the restricting member 23). Therefore, the circumferential speed of the slide contact surfaces is lower than that in an arrangement in which the drive side contact surface is positioned radially outwardly of the clutch teeth 21*b* of the clutch plate 21 and the driven side contact surface is positioned radially outwardly of the clutch teeth 15*d* of the spindle 15. As a result, it is possible to reduce wear of the drive side and driven side contact surfaces (in particular, wear of the tapered surface 21*d* of the restricting shaft portion 21*c*).

When the screw driving operation is completed after the forward movement of the spindle 15 according to the proceeding of the driving operation, the clutch teeth 15*d* of the spindle 15 are disengaged from the clutch teeth 21*b* of the clutch plate 21, so that transmission of rotation is interrupted. At the same time, resistance against rotation of the clutch plate 21 is released and the clutch plate 21 moves to return toward the drive gear 11. Therefore, disengagement between the clutch teeth 15*d* of the spindle 15 and the clutch teeth 21*b* of the clutch plate 21 immediately occurs, so that the drive gear 11 silently rotates idle. After that, if the pressing force applied to the power screwdriver 1 is released, the spindle 15 returns to the initial position or its front stroke end by the action of the spring 26. As shown in FIG. 4, when the spindle 15 has returned to the initial position, the restricting member 23 is completely separated from the restricting shaft portion 21*c* and may not produce any friction against the restricting shaft portion 21*c*. Hence, no rotational force is transmitted via the synchronization mechanism 25. Therefore, it is possible to reduce wear of the restricting shaft portion 21*c* and the restricting member 23 and to reliably prevent the spindle 15 from rotating together with the clutch plate 21.

Further, according to the synchronization mechanism 25 of the above example, the synchronization rotational force is transmitted through frictional sliding contact of restricting member 23 with the tapered surface 21*d*. Therefore, as the retreating distance of the spindle 15 increases, the sliding resistance (or the frictional force) of the restricting member 23 against the tapered surface 21*d* of the clutch plate 21 increases to cause increase of the synchronization rotational force. As a result, it is possible to further reduce an impact that may be produced when the driven side clutch teeth 15*d* engage the drive side clutch teeth 21*b*.

Further, in the exemplified clutch mechanism 10, the compression spring 26 is interposed between the clutch plate 21 and the flange portion 15*c* of the spindle 15 at a position on the outer circumferential side of the clutch teeth 15*d* and 21*b* and serves as a second synchronization mechanism. Therefore, it is possible to further reliably produce the synchronization rotation.

Furthermore, because a silent clutch function is provided in addition to the synchronization function provided by the synchronization mechanism 25, it is possible to ensure the silent property both at the time of connecting the clutch and at the time of disconnecting the clutch. Therefore, it is possible to improve the durability of the power screwdriver 1.

Furthermore, the co-rotation preventing member 24 is mounted to the housing 3*a* of the tool body 3 for more reliably preventing the spindle 15 from rotating with the clutch plate 21. Therefore, when the spindle 15 has returned to the initial position, it is possible to also reliably prevent the spindle 15 from rotation in addition to prevention by the separation of the restricting member 23 from the restricting shaft portion 21*c* for interrupting the operation of the synchronization mechanism 25 described above.

Furthermore, the synchronization mechanism 25 of this example is configured by providing the restricting member 23 and the restricting shaft 21*c* that are positioned radially inwardly of the clutch teeth 15*d* and 21*b*, respectively, of the meshing clutch mechanism 10. Therefore, it does not cause increase in size of the clutch mechanism 10 in the radial direction. Eventually, it is possible to improve the silent property and the durability of the clutch mechanism 10 while keeping the power screwdriver 1 to be downsized.

The above example can be modified in various ways. In the above example, the restricting member 23 for the synchronized rotation is provided on the side of the restricting recess 15*b* for contacting with the outer circumferential surface of the restricting shaft portion 21*c* of the clutch plate 21. Thus, the restricting shaft portion 21*c* serves as a drive side contact member having a drive side contact surface, and the restricting member 23 serves as a driven side contact member having a driven side contact surface for contacting with the drive side contact surface. However, it is possible to provide the restricting member 23 at the restricting shaft portion 21*c* of the clutch plate 21, so that the restricting member 23 slidably contacts the inner circumferential surface of the restricting recess 15*b* to transmit the rotation of the drive side to the spindle 15 for causing the synchronized rotation. In this case, the restricting member 23 serves as a drive side contact member having a drive side contact surface, and a portion of the spindle 15 having the restricting recess 15*b* serves as a driven side contact member having a driven side contact surface for slidably contacting the drive side contact surface. Further, a separate contact member for contacting the restricting member 23 may be coupled to the spindle 15 or the clutch plate 21 for rotation therewith.

Further, although the flange portion 15*c* integrated with the spindle 15 serves as a driven side clutch member in the above example, a driven side clutch member that is a separate member from the spindle 15 may be coupled to the spindle 15 for rotation therewith.

Further, the clutch mechanism 10 may be modified such that it does not include the balls 22 between the drive gear 11 and the clutch plate 21. In such a case, the drive gear 11 and the clutch plate 21 may be integrated together and the clutch mechanism 10 does not have a silent mechanism.

Further, although the clutch mechanism 10 of the above example is configured as a meshing clutch mechanism having clutch teeth 15*d* and 21*b* for transmitting rotation, the synchronization mechanism 25 can also be applied to any other clutch mechanisms, such as a friction clutch mechanism and an electromagnetic clutch mechanism, having driven side and drive side clutch members that include clutch portions configured differently from the clutch teeth.

What is claimed is:

1. A power screwdriver comprising:

a rotary drive device;

a spindle configured to be capable of mounting a driver bit;

a clutch mechanism configured to transmit rotation of the rotary drive device to the spindle and comprising a drive side clutch member coupled to the rotary drive device and a driven side clutch member coupled to the spindle;

wherein the drive side clutch member and the driven side clutch member have drive side clutch teeth and driven side clutch teeth, respectively, and;

wherein the drive side clutch teeth and the driven side clutch teeth engage with each other and disengaged from each other according to the position of the driven side clutch member in an axial direction relative to the drive side clutch member; and a synchronization mechanism comprising a drive side contact member and a driven side contact member;

wherein the drive side contact member and the driven side contact member are provided on the drive side clutch member and the driven side clutch member at positions radially inwardly of the drive side clutch teeth and the driven side clutch teeth, respectively;

wherein prior to engagement of the driven side clutch teeth with the drive side clutch teeth in the midway of the axial movement of the driven side clutch member in a retreating direction, the drive side contact member and the driven side contact member frictionally slidably contact each other to transmit rotation of the drive side clutch member to the driven side clutch member.

2. The power screwdriver as in claim 1, wherein the drive side contact member and the driven side contact member are configured to increase the frictional force between the drive side contact member and the driven side contact member as a moving distance of the driven side clutch member in the retreating direction increases.

3. The power screwdriver as in claim 2, wherein:

the drive side clutch member includes a restricting shaft portion;

the driven side clutch member includes a restricting recess configured to receive the restricting shaft portion;

a restricting member is mounted to one of an outer circumferential surface of the restricting shaft portion and an inner circumferential surface of the restricting recess;

a tapered surface is formed on the other of the outer circumferential surface of the restricting shaft portion and the inner circumferential surface of the restricting recess;

the drive side contact member includes one of the restricting member and the tapered surface; and the driven side contact member includes the other of the restricting member and the tapered surface.

4. The power screwdriver as in claim 3, wherein:

the drive side contact member includes the tapered surface formed on the outer circumferential surface of the restricting shaft portion; and the driven side contact member includes the restricting member mounted to the inner circumferential surface of the restricting recess.

5. The power screwdriver as in claim 4, wherein the restricting member is a resilient member.

6. The power screwdriver as in claim 5, wherein the resilient member is a rubber ring.

7. The power screwdriver as in claim 1, further comprising a biasing device interposed between the drive side clutch member and the driven side clutch member for biasing the driven side clutch member toward an initial position in a direction opposite to the retreating direction.

8. The power screw drive as in claim 1, wherein:

the drive side clutch member includes:

a first drive clutch member coupled to the rotary drive device and having the drive side clutch teeth and first cam recesses;

a second drive clutch member having second cam recesses; and balls interposed between the first drive clutch member and the second drive clutch member and each fitted into one of the first cam recesses and one of the second cam recesses, so that the first drive clutch member moves in the axial direction to cause engagement and disengagement of the drive side clutch teeth with the driven side clutch teeth as the first drive clutch member rotates relative to the second drive clutch member.

9. The power screwdriver as in claim 1, further comprising a co-rotation preventing member, wherein the co-rotation preventing member engages the driven side clutch member to prevent rotation of the driven side clutch member when the driven side clutch member returns to an initial position in a direction opposite to the retreating direction.

10. A clutch mechanism comprising:

a drive side clutch member having a drive-side clutch portion;

a driven side clutch member having a driven side clutch portion engageable with the drive-side clutch portion;

wherein the driven side clutch member is movable relative to the drive side clutch member in an axial direction between an engaging position and a disengaging position, where the driven side clutch portion is engaged with and disengaged from the drive side clutch portion, respectively; and a synchronization mechanism comprising a drive side contact member and a driven side contact member provided on the drive side clutch member and the driven side clutch member at positions radially inwardly of the drive side clutch portion and the driven side clutch portion, respectively;

wherein the driven side contact member does not contact the drive side contact member when the driven side clutch member is in the disengaging position;

wherein as the driven side clutch member moves from the disengaging position to the engaging position, the driven side contact member contacts the drive side contact member, so that the rotation of the drive side clutch member is transmitted to the driven side clutch member through frictional contact between the driven side contact member and the drive side contact member before the driven side clutch member reaches the engaging position.

11. The clutch mechanism as in claim 10, wherein the driven-side contact member and the drive-side contact member are configured such that a frictional force between the driven-side contact member and the drive side contact member increases as a moving distance of the driven side clutch member from the disengaging position toward the engaging position increases.

12. The clutch mechanism as in claim 11, wherein:

the drive side clutch member includes a restricting shaft portion;

the driven side clutch member includes a restricting recess configured to receive the restricting shaft portion;

a restricting member is mounted to one of an outer circumferential surface of the restricting shaft portion and an inner circumferential surface of the restricting recess;

a tapered surface is formed on the other of the outer circumferential surface of the restricting shaft portion and the inner circumferential surface of the restricting recess;

the drive side contact member includes one of the restricting member and the tapered surface; and the driven side contact member includes the other of the restricting member and the tapered surface.

13. The clutch mechanism as in claim 12, wherein:

the drive side contact member includes the tapered surface formed on the outer circumferential surface of the restricting shaft portion; and the driven side contact member includes the restricting member mounted to the inner circumferential surface of the restricting recess.

14. The clutch mechanism as in claim 13, wherein the restricting member is a resilient member.

15. The clutch mechanism as in claim 14, wherein the resilient member is a rubber ring.

16. The clutch mechanism as in claim 10, further comprising a biasing device interposed between the drive side clutch member and the driven side clutch member for biasing the driven side clutch member toward the disengaging position.

17. The clutch mechanism as in claim 10, wherein:

the drive side clutch member includes:

a first drive clutch member coupled to a rotary drive device and having the drive side clutch portion and first cam recesses;

a second drive clutch member having second cam recesses; and balls interposed between the first drive clutch member and the second drive clutch member and each fitted into one of the first cam recesses and one of the second cam recesses, so that the first drive clutch member moves in the axial direction to cause engagement and disengagement of the drive side clutch portion with the driven side clutch portion as the first drive clutch member rotates relative to the second drive clutch member.

18. The clutch mechanism as in claim 10, further comprising a rotation preventing member, wherein the rotation preventing member engages the driven side clutch member to prevent rotation of the driven side clutch member when the driven side clutch member is positioned at the disengaging position.

19. A power screwdriver comprising the clutch mechanism as in claim 10 and further comprising:

a rotary drive device; and a spindle configured to be capable of mounting a driver bit;

wherein the drive side clutch member and the driven side clutch member are coupled to the rotary drive device and the spindle, respectively.

20. A clutch mechanism comprising:

a drive side clutch member having a drive-side clutch portion;

a driven side clutch having a driven side clutch portion engageable with the drive-side clutch portion;

wherein the driven side clutch member is movable relative to the drive side clutch member in an axial direction between an engaging position and a disengaging position, where the driven side clutch portion is engaged with and disengaged from the drive side clutch portion, respectively; and a synchronization mechanism comprising a resilient member mounted to one of the drive side clutch member and the driven side clutch member and disposed radially inwardly thereof;

wherein the resilient member does not contact the other of the drive side clutch member and the driven side clutch member when the driven side clutch member is in the disengaging position;

wherein as the driven side clutch member moves from the disengaging position to the engaging position, the resilient member frictionally contacts the other of the other of the drive side clutch member and the driven side clutch member, so that the rotation of the drive side clutch member is transmitted to the driven side clutch member via the resilient member before the driven side clutch member reaches the engaging position.

21. The clutch device as in claim 20, wherein the other of the drive side clutch member and the driven side clutch member has a tapered surface having a diameter varying along the axial direction, the resilient member frictionally contacts the tapered surface, so that a frictional force between the resilient member and the tapered surface increase as the driven side clutch member moves toward the engaging position.

22. The clutch device as in claim 21, wherein the resilient member is a rubber ring.

* * * * *